US007357428B2

(12) United States Patent
Kletscher

(10) Patent No.: US 7,357,428 B2
(45) Date of Patent: Apr. 15, 2008

(54) FIXING DEVICE FOR A MOVABLE WALL

(75) Inventor: Wilfried Kletscher, Bad Salzuflen (DE)

(73) Assignee: Dorma GmbH + Co. KG, Ennepetal (DE)

( * ) Notice: Subject to any disclaimer, the term of this patent is extended or adjusted under 35 U.S.C. 154(b) by 300 days.

(21) Appl. No.: 10/518,976

(22) PCT Filed: Apr. 23, 2004

(86) PCT No.: PCT/EP2004/004322

§ 371 (c)(1),
(2), (4) Date: Dec. 21, 2004

(87) PCT Pub. No.: WO2004/097132

PCT Pub. Date: Nov. 11, 2004

(65) Prior Publication Data

US 2005/0252098 A1 Nov. 17, 2005

(30) Foreign Application Priority Data

Apr. 25, 2003 (DE) ..... 203 06 551

(51) Int. Cl.
*E05C 1/06* (2006.01)

(52) U.S. Cl. ..... 292/139; 292/DIG. 46

(58) Field of Classification Search .... 52/127.5–127.6, 52/127.12, 64, 71; 160/201–209; 292/139, 292/166, 167, 140, 169, 245, DIG. 46; 16/93 R, 16/94 R, 96 R, 87, DIG. 35; 70/379 R, 70/99, 100, 380

See application file for complete search history.

(56) References Cited

U.S. PATENT DOCUMENTS 241,998 A * 5/1881 King ..... 292/140
1,524,005 A * 1/1925 Dodge ..... 160/113
2,905,495 A * 9/1959 Adamson ..... 292/244
2,961,263 A * 11/1960 Ahlgren ..... 292/140
3,201,959 A * 8/1965 Yeager ..... 70/134
3,591,218 A * 7/1971 Gowland ..... 292/140
3,762,750 A * 10/1973 Orr ..... 292/140
4,438,594 A * 3/1984 Bunzl ..... 49/177
4,550,580 A * 11/1985 Neyret ..... 70/370
4,555,880 A * 12/1985 Gzym et al. ..... 52/126.4
4,662,666 A * 5/1987 Wimmer ..... 292/1.5
4,688,406 A * 8/1987 Horgan, Jr. ..... 70/100
4,691,951 A * 9/1987 Fildan ..... 292/337

(Continued)

FOREIGN PATENT DOCUMENTS

GB 226264 12/1924

(Continued)

*Primary Examiner*—Richard E. Chilcot
*Assistant Examiner*—Gay Ann Spahn
(74) *Attorney, Agent, or Firm*—Cohen Pontani Lieberman & Pavane LLP

(57) ABSTRACT

The invention is directed to a fixing device for a movable wall or the like with a fixing element which can be brought into its working position by an actuating member that can be actuated manually. In order to provide a fixing device for a movable wall or the like which ensures a reliable and trouble-free operation in a simple manner, it is provided according to the invention that the actuating member is constructed as a turning knob whose rotating movement can be transformed into a longitudinal movement for the fixing element.

7 Claims, 1 Drawing Sheet

U.S. PATENT DOCUMENTS

| | | | | |
|---|---|---|---|---|
| 4,838,058 | A * | 6/1989 | Matsumoto | 70/355 |
| 4,976,122 | A * | 12/1990 | Doolan et al. | 70/134 |
| 5,044,183 | A * | 9/1991 | Neyret | 70/223 |
| 5,394,648 | A | 3/1995 | Kordes | |
| 6,018,915 | A * | 2/2000 | Pomish et al. | 52/64 |
| 6,098,342 | A * | 8/2000 | Bischof et al. | 49/409 |
| 6,108,989 | A * | 8/2000 | Kordes et al. | 52/243.1 |
| 6,415,565 | B1 * | 7/2002 | Sosa | 52/207 |
| 6,622,534 | B1 * | 9/2003 | Miller et al. | 70/92 |
| 6,851,730 | B2 * | 2/2005 | Haab et al. | 292/103 |
| 6,883,935 | B2 * | 4/2005 | Lassovsky | 362/283 |
| RE38,832 | E * | 10/2005 | Thwing | 70/389 |
| 2006/0192394 | A1 * | 8/2006 | Cennamo, Jr. | 292/139 |

FOREIGN PATENT DOCUMENTS

| | | |
|---|---|---|
| GB | 736439 | 9/1955 |
| GB | 2292974 | 3/1996 |

* cited by examiner

FIXING DEVICE FOR A MOVABLE WALL

PRIORITY CLAIM

This is a U.S. national stage of application No. PCT/EP2004/004322, filed on 23 Apr. 2004. Priority under 35 U.S.C. 119(a) and 35 U.S.C. §365(b) is claimed from German Application No. 203 06 551.4, filed 25 Apr. 2003.

BACKGROUND OF THE INVENTION

1. Field of the Invention

The invention is directed to fixing device for a movable wall with a fixing element which can be brought into its working position by an actuating member that can be actuated manually.

2. Description of the Related Art

Fixing devices of the kind mentioned above are required in walls that are movable manually in order to fix the walls in a determined position. Known fixing devices have a slide which is guided in an elongated hole provided in the wall and which when activated moves a fixing element connected to the slide into its working position.

A fixing device of this kind has the disadvantage that the slide must be received in the elongated hole with play and that dirt and contaminants which impair the operation of the fixing device can therefore deposit in the elongated hole and under the slide.

Therefore, it is the object of the present invention to provide a fixing device for a movable wall or the like which ensures a reliable and trouble-free operation in a simple manner.

SUMMARY OF THE INVENTION

According to the invention, the fixing device includes a profile which can receive the movable wall, and a fixing element which can be moved linearly into and out of a working position. The actuating member is a turning knob mounted for rotation in the profile, this rotation being translated into linear movement of the fixing element.

By designing the actuating member as a turning knob whose rotating movement is translated into a longitudinal movement for the fixing element, the arrangement of an elongated hole in the wall becomes unnecessary and the slide can be dispensed with in its entirety. Therefore, the fixing device according to the invention is less susceptible to dirt and other contaminants.

According to an advantageous further development, the turning knob is arranged in a recess in the wall, which recess surrounds the turning knob with a slight play. The penetration of dirt can be effectively prevented in that the turning knob fills the opening provided in the wall almost completely, so that a reliable operation of the fixing device according to the invention can be ensured over a long period of time.

In order to ensure that the turning knob can be actuated with a good grip, the turning knob is provided with knurling on its circumferential surface in an advantageous further development.

According to a preferred embodiment form, the turning knob is provided on its side facing the wall with an axle stub for rotatable support of the turning knob and is provided with an eccentric pin eccentric thereto. This enables a secure support of the turning knob in the wall and at the same time ensures a reliably functioning connection to the fixing element.

The eccentric pin advantageously engages in a slotted link which is connected to the fixing element. A good, reliable transformation of the rotating movement of the turning knob into a longitudinal movement of the fixing element is achieved due to this step.

In order to further improve the guiding of the turning knob, it is provided according to an advantageous further development that the eccentric pin is guided in a circular path arranged in the wall, the ends of the circular path serving as a stop for the rotating movement of the turning knob. The end positions of the rotating movement and therefore the two end positions of the fixing element can be reliably defined in this way.

The circular path is preferably constructed as a quarter circle in order that the fixing element can move out with the smallest possible angle of rotation.

According to an advantageous further development, the fixing element is constructed as a catch pin. The fixing element can therefore be produced in a simple manner.

In order to guide the fixing device according to the invention in a reliable manner and, above all, so as to be free from tilting, the fixing element is guided in a support or carrier in its displacement direction. The carrier is held at a rail arranged in the wall such that it can be displaced and secured. In addition, this enables a certain adjustment of the fixing device.

DETAILED DESCRIPTION OF THE PRESENTLY PREFERRED EMBODIMENTS

Figure 4:
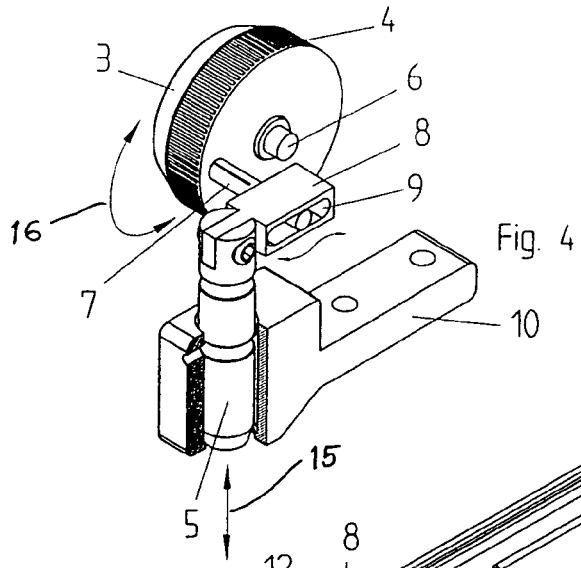
FIG. 4 shows another view of the fixing device according to the invention.
Figure 3:
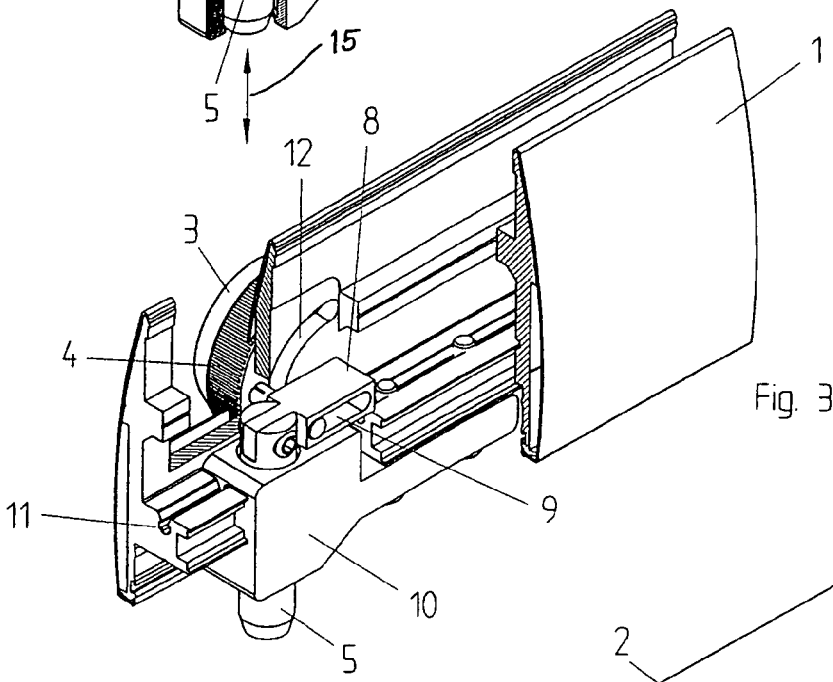
FIG. 3 shows a partial section through the fixing device according to the invention.
Figure 2:
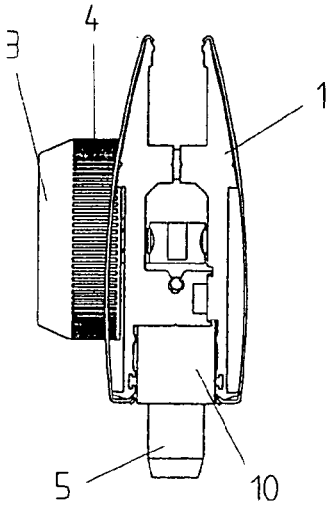
FIG. 2 shows a cross section through the fixing device according to the invention.
Figure 1:
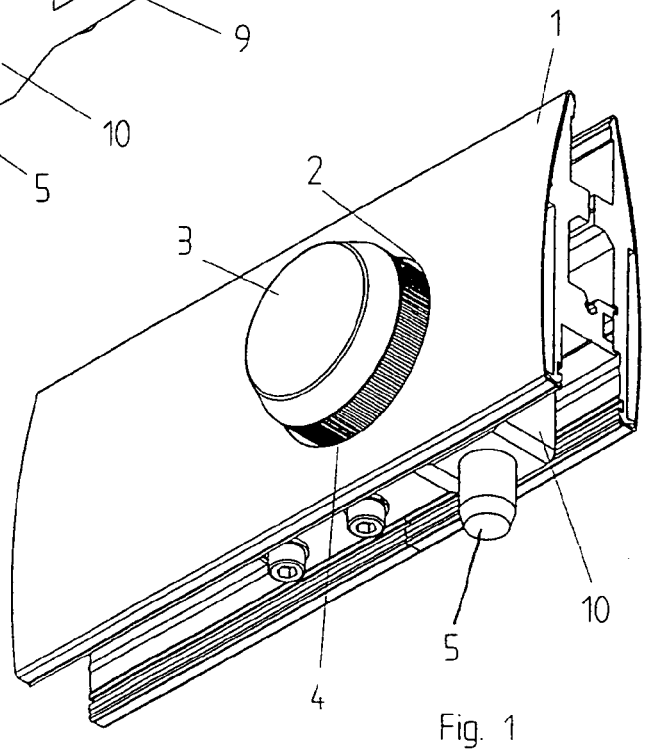
FIG. 1 shows a view of the fixing device according to the invention.

FIGS. 1 to 4 show a fixing device according to the invention which is arranged at a wall that is preferably manually movable. The wall (not shown) passes into a profile 1 in its lower area. The profile 1 which comprises two half profile shells in the present embodiment example is provided with slightly curved outer sides (see FIG. 2).

A circular recess 2 in which a turning knob 3 is supported is provided in the profile 1. The recess 2 encloses the turning knob 3 with a slight play so that dirt or dust can be prevented to a great extent from penetrating into the gap between the recess 2 and the turning knob 3. The turning knob 3 is provided on its outer circumference with knurling 4 to enable the turning knob 3 to be actuated in a reliable fashion.

The turning knob 3 is in a working connection with a fixing element 5 constructed as a catch pin so that the fixing element 5 can be moved out and in by actuating the turning knob 3.

The turning knob 3 is provided on its inner side with a centric axle stub 6 enabling a rotatable support of the turning knob 3 in the profile 1. An eccentric pin 7 is provided in the vicinity of the outer edge of the turning knob 3 eccentric to the axle stub 6. The turning knob 3 with the axle stub 6 and eccentric pin 7 can be produced in one piece, e.g., by means of injection molding.

The eccentric pin 7 engages in a slotted link 8 which receives the eccentric pin 7 in an elongated hole 9. The slotted link 8 itself is connected to the fixing element 5, for example, by means of a screw connection.

The fixing element 5 is guided in its displacing direction in a carrier 10 which is held in a rail 11 provided in the profile 1 so that it can be displaced and secured. Further, a circular path 12 which is constructed as a quarter circle and through which the eccentric pin 7 extends is provided in the profile 1. The ends of the circular path 12 serve as a stop and define the rotating movement of the turning knob 3 and, therefore, the displacement path of the fixing element 5.

When the turning knob 3 is turned, the eccentric pin 7 moves in the elongated hole 9 of the slotted link 8 and accordingly moves the fixing element 5 downward or upward, as indicated by arrow 16, depending on the rotating direction of knob 4, as indicated by arrow 15. In this way, the rotating movement of the turning knob 3 is transformed into a longitudinal movement of the fixing element 5.

What is claimed is:

1. A fixing device for a movable wall, the fixing device comprising:

a profile having first recess capable of receiving the movable wall;

a fixing element which is linearly movable with respect to said profile, into and out of a working position;

a turning knob mounted for rotation in said profile, said turning knob having a stub axle which is journaled for rotation in said profile;

an eccentric pin fixed to the turning knob eccentric to the stub axle; and a slotted link fixed to the fixing element, the slotted link having a slot which receives said eccentric pin to translate rotational movement of said knob into linear movement of said fixing element.

2. The fixing device of claim 1 wherein said profile has a second recess which receives said turning knob.

3. The fixing device of claim 1 wherein the turning knob has a knurled circumferential surface.

4. The fixing device of claim 1 further comprising an arcuate slot in said profile, said eccentric pin being received in said arcuate slot, said arcuate slot limiting rotational movement of said knob.

5. The fixing device of claim 4 wherein the arcuate slot covers a quarter circle.

6. The fixing device of claim 1 wherein the fixing element is a catch pin.

7. The fixing device of claim 1 wherein said profile comprises a rail, said device further comprising a carrier secured to said rail, said carrier guiding said fixing element for linear movement.

* * * * *